US012642294B2

(12) United States Patent
Jeoung

(10) Patent No.: US 12,642,294 B2
(45) Date of Patent: Jun. 2, 2026

(54) AEROSOL GENERATING ARTICLE COMPRISING COMBUSTIBLE HEAT SOURCE

(71) Applicant: KT&G CORPORATION, Daejeon (KR)

(72) Inventor: Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 539 days.

(21) Appl. No.: 17/917,124

(22) PCT Filed: Jun. 8, 2022

(86) PCT No.: PCT/KR2022/008083
§ 371 (c)(1),
(2) Date: Oct. 5, 2022

(87) PCT Pub. No.: WO2022/260429
PCT Pub. Date: Dec. 15, 2022

(65) Prior Publication Data

US 2024/0215637 A1 Jul. 4, 2024

(30) Foreign Application Priority Data

Jun. 11, 2021 (KR) ..... 10-2021-0076309

(51) Int. Cl.

| | |
|---|---|
| ***A24D 1/22*** | (2020.01) |
| ***A24D 1/00*** | (2020.01) |
| ***A24D 1/02*** | (2006.01) |
| ***A24D 1/04*** | (2006.01) |

(52) U.S. Cl.
CPC ..... *A24D 1/22* (2020.01); *A24D 1/002* (2013.01); *A24D 1/02* (2013.01); *A24D 1/045* (2013.01)

(58) Field of Classification Search
None
See application file for complete search history.

(56) References Cited

U.S. PATENT DOCUMENTS

| | | | | |
|---|---|---|---|---|
| 2011/0088707 | A1 | 4/2011 | Hajaligol | |
| 2017/0238607 | A1 | 8/2017 | Nordskog | |
| 2019/0090537 | A1 | 3/2019 | Nordskog et al. | |
| 2019/0124972 | A1 | 5/2019 | Nakano et al. | |
| 2019/0230990 | A1 | 8/2019 | Hepworth | |
| 2020/0128880 | A1* | 4/2020 | Gage | A24D 1/14 |
| 2020/0352256 | A1 | 11/2020 | Hejazi et al. | |

FOREIGN PATENT DOCUMENTS

| | | | |
|---|---|---|---|
| CN | 108882747 | A | 11/2018 |
| EA | 201990193 | A1 | 6/2019 |
| EP | 3 459 374 | B1 | 4/2022 |
| GB | 2587508 | B | 9/2021 |
| JP | 2019-528784 | A | 10/2019 |

(Continued)

OTHER PUBLICATIONS

Extended European Search Report dated Sep. 14, 2023 in Application No. 22772400.2.

(Continued)

*Primary Examiner* — Phu H Nguyen
(74) *Attorney, Agent, or Firm* — Sughrue Mion, PLLC

(57) ABSTRACT

Provided is an aerosol generating article including a combustible heat source.

10 Claims, 6 Drawing Sheets

(56) References Cited

FOREIGN PATENT DOCUMENTS

| | | | |
|---|---|---|---|
| KR | 10-2005-0003906 | A | 1/2005 |
| KR | 10-2018-0122365 | A | 11/2018 |
| KR | 10-2019-0021424 | A | 3/2019 |
| KR | 10-2019-0047021 | A | 5/2019 |
| KR | 10-2020-0134331 | A | 12/2020 |
| WO | 2018/003870 | A1 | 1/2018 |
| WO | 2018/050720 | A1 | 3/2018 |

OTHER PUBLICATIONS

Japanese Office Action dated Oct. 31, 2023 in Application No. 2022-563050.
Written Opinion dated Sep. 15, 2022 in Korean Application No. PCT/KR2022/008083.
International Search Report dated Sep. 15, 2022 in International Application No. PCT/KR2022/008083.
Office Action dated May 11, 2025 in Chinese Application No. 202280003146.4.

* cited by examiner

AEROSOL GENERATING ARTICLE COMPRISING COMBUSTIBLE HEAT SOURCE

CROSS REFERENCE TO RELATED APPLICATIONS

This application is a National Stage of International Application No. PCT/KR2022/008083 filed Jun. 8, 2022, claiming priority based on Korean Patent Application No. 10-2021-0076309 filed Jun. 11, 2021.

TECHNICAL FIELD

The present disclosure relates to an aerosol generating article including a combustible heat source.

BACKGROUND ART

Recently, the demand for alternative methods to overcome the disadvantages of traditional cigarettes has increased. For example, studies on a technology for generating an aerosol by transferring heat from a combustible heat source to a physically separated aerosol forming substrate have been actively conducted.

However, combustible heat sources of the related art do not exhibit flame-like characteristics of normal combustion when ignited. Accordingly, it is difficult for a user to check whether the combustible heat source is ignited.

DESCRIPTION OF EMBODIMENTS

Technical Problem

An aerosol generating article according to embodiments may resolve the above-described issues of the related art.

However, technical problems are not limited to the above description, and other technical problems may be derived from the embodiments described hereinafter.

Solution to Problem

According to an aspect of the present disclosure, provided is an aerosol generating article including a first portion including a combustible heat source, a second portion including a tobacco element, and a third portion including a filter element, wherein the first portion, the second portion, and the third portion are sequentially arranged in a longitudinal direction of the aerosol generating article, and the combustible heat source includes a flavoring element.

According to another aspect of the present disclosure, provided is a combustible heat source for an aerosol generating article, the combustible heat source including a flavoring element.

Technical solutions are not limited to the above description, and may include all matters that may be derived by those of ordinary skill in the art throughout the present specification.

Advantageous Effects of Disclosure

An aerosol generating article according to an aspect of the present disclosure may inform a user that a combustible heat source is ignited by using a flavoring element.

In addition, a combustible heat source for an aerosol generating article according to another aspect of the present disclosure may include a flavoring element, and thus, an aroma may be generated after the combustible heat source is ignited, and the user may recognize that the combustible heat source is ignited by inhaling the aroma.

Effects of the present disclosure are not limited to the above description, and may include all effects that may be derived from configurations described below.

BEST MODE

Figure 1:
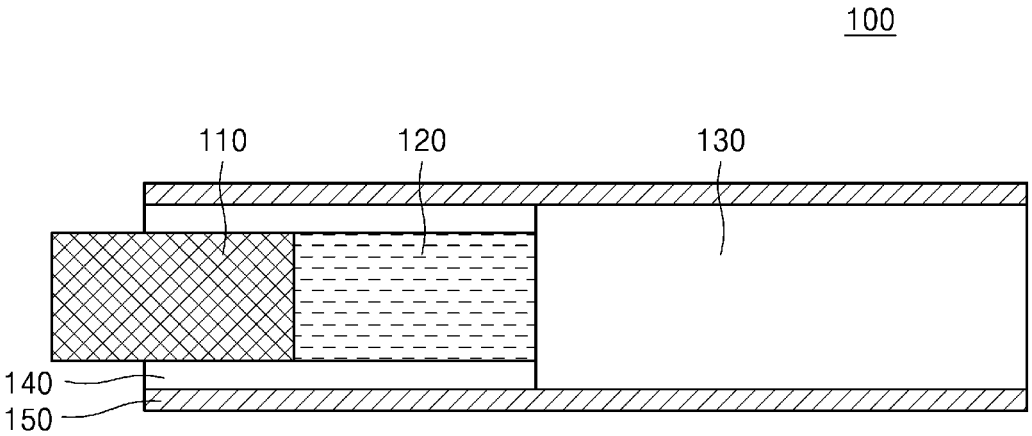
FIG. 1 is a diagram schematically illustrating a configuration of an aerosol generating article according to an embodiment.

According to an aspect of the present disclosure, provided is an aerosol generating article including a first portion including a combustible heat source, a second portion including a tobacco element, and a third portion including a filter element, wherein the first portion, the second portion, and the third portion may be sequentially arranged in a longitudinal direction of the aerosol generating article, and the combustible heat source may include a flavoring element.

The flavoring element may be configured to generate an aroma after the combustible heat source is ignited.

The flavoring element may include a flavoring material selected from among a tobacco material, licorice, sucrose, fructose syrup, cocoa, coffee, and combinations thereof.

The flavoring element may be arranged apart from an end of the first portion which is opposite to another end of the first portion, the other end being adjacent to the second portion.

The aerosol generating article may further include a first wrapper surrounding at least a portion of the first portion and the second portion.

The combustible heat source may include a first area and a second area, the first area being surrounded by the first wrapper, and the second area protruding outward of the first area and having the flavoring element arranged therein.

The combustible heat source may include a plurality of flavoring elements, and the plurality of flavoring elements may be arranged apart from each other in the longitudinal direction of the aerosol generating article.

The flavoring element may have a capsule form, and may be arranged inside the combustible heat source.

The flavoring element may have a sheet form, and may surround at least a portion of the combustible heat source.

The flavoring element may have an elongated form, and may be arranged on the combustible heat source coaxially with the longitudinal direction of the aerosol generating article.

According to another aspect of the present disclosure, provided is a combustible heat source for an aerosol generating article, the combustible heat source including a flavoring element.

The flavoring element may be configured to generate an aroma after the combustible heat source is ignited.

MODE OF DISCLOSURE

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

In addition, terms including ordinal numbers such as "first" or "second" used in the present specification may be used to describe various components, but the components are not limited by the terms. The terms are only used to distinguish one component from other components.

Throughout the specification, "A and/or B" refers to at least one of A and B.

Throughout the specification, "on" indicates that a member is arranged on one surface of another member, and includes all cases where a member is arranged in contact with or without contact with another member.

Throughout the specification, an "aerosol generating article" refers to an article used for smoking. For example, the aerosol generating article may include a general combustion cigarette that is used in a manner of being ignited and combusted, or may include a heated cigarette that is used in a manner of being heated by an aerosol generating device.

Throughout the specification, a "longitudinal direction of an aerosol generating article" refers to a direction in which the length of the aerosol generating article extends, or a direction in which combustion proceeds when the aerosol generating article is combusted.

Throughout the specification, a "tobacco element" refers to an element including a tobacco material.

Throughout the specification, a "tobacco material" refers to any form of material including components derived from tobacco leaves.

Throughout the specification, a "cooling element" refers to an element that cools a material. For example, the cooling element may cool an aerosol generated by an aerosol generating element or a tobacco element.

Throughout the specification, a "filter element" refers to an element including a filtering material. For example, the filter element may include a plurality of fiber strands.

Throughout the specification, a "flavoring element" refers to an element including a flavoring material. Here, the flavoring material refers to a material capable of providing flavor to a user by being entrained with generated aerosol.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a diagram schematically illustrating a configuration of an aerosol generating article according to an embodiment.

An aspect of the present disclosure may provide an aerosol generating article 100 including a first portion 110 including a combustible heat source containing a flavoring element, a second portion 120 including a tobacco element, and a third portion 130 including a filter element, wherein the first portion 110, the second portion 120, and the third portion 130 may be sequentially arranged in a longitudinal direction of the aerosol generating article 100. In addition, in an embodiment, the aerosol generating article 100 may further include a first wrapper 140 and a second wrapper 150.

Referring to FIG. 1, the first portion 110, the second portion 120, and the third portion 130 may be sequentially arranged in the longitudinal direction of the aerosol generating article 100. Heat generated from the combustible heat source arranged in the first portion 110 may be transferred to the second portion 120. An aerosol may be generated in the second portion 120 due to the heat, and the aerosol may be transferred to a user through the third portion 130.

The first portion 110 may include a combustible heat source. The combustible heat source may be ignited and combusted, thereby generating heat. The generated heat may be transferred to an aerosol generating material in the aerosol generating article 100 to generate an aerosol. The combustible heat source may include a heat source including carbon. Preferably, the combustible heat source may include a heat source including charcoal. In addition, the combustible heat source may further include an auxiliary agent. For example, the auxiliary agent may include at least one of an ignition auxiliary agent, a combustion auxiliary agent, a sintering auxiliary agent, and a binder.

The combustible heat source may include a flavoring element. In the manufacture of the combustible heat source, by adding the flavoring element to the combustible heat source, the combustible heat source may include the flavoring element. For example, the combustible heat source may be molded by mixing a material for forming the combustible heat source with a flavoring liquid including a flavoring material. In addition, after the combustible heat source is molded, the combustible heat source may be impregnated into the flavoring liquid. However, embodiments are not limited thereto.

The flavoring element may include a flavoring material. The flavoring material may be selected from among a tobacco material, licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, caraway, cognac, jasmine, chamomile, menthol, ylang-ylang, sage, spearmint, ginger, coriander, coffee, and combinations thereof, but is not limited thereto. Preferably, the flavoring element may include a flavoring material selected from among a tobacco material, licorice, sucrose, fructose syrup, cocoa, coffee, and combinations thereof. More preferably, the flavoring element may include a tobacco material.

The flavoring element may generate an aroma after the combustible heat source is ignited. A combustible heat source of the related art undergoes surface combustion when ignited, and thus does not exhibit flame-like characteristics of normal combustion. Accordingly, it is difficult for the user to check whether the combustible heat source is ignited. However, because the aerosol generating article 100 of the present disclosure includes a combustible heat source, and the combustible heat source includes a flavoring element, when the combustible heat source is ignited and combusted, the flavoring element may generate an aroma due to heat generated by the combustion. Accordingly, by inhaling the generated aroma, the user may easily confirm that the combustible heat source is ignited.

The second portion 120 may be arranged adjacent to the first portion 110. For example, the first portion 110 may be arranged at an upstream of the aerosol generating article 100 and the second portion 120 may be arranged at a downstream of the aerosol generating article 100 relative to the first portion 110.

Regarding the terms "upstream" and "downstream" used herein, when the user inhales air by using the aerosol generating article 100, a portion where the air enters the aerosol generating article 100 from the outside is the "upstream", and a portion where the air exits the aerosol generating article 100 from the inside is the "downstream". The terms "upstream" and "downstream" are used to indicate relative positions or directions of portions or segments that constitute the aerosol generating article 100.

The second portion 120 may include a tobacco element. The tobacco element may include at least one of an aerosol generating material and a tobacco material. The aerosol generating material may include, for example, at least one of glycerin, propylene glycol, ethylene glycol, dipropylene glycol, diethylene glycol, triethylene glycol, tetraethylene glycol, and oleyl alcohol. The tobacco material may include, for example, at least one of cut tobacco, cut reconstituted tobacco, tobacco leaves, expanded tobacco, and nicotine extract. The tobacco material may include a nicotine component.

For example, the second portion 120 may include cut reconstituted tobacco impregnated in glycerin. As the combustible heat source of the first portion 110 is ignited and combusted, heat generated therefrom may be transferred to the second portion 120, and an aerosol may be generated from the cut reconstituted tobacco impregnated in glycerin. However, the present disclosure is not limited thereto.

The third portion 130 may be arranged adjacent to the second portion 120. For example, the second portion 120 may be arranged at the upstream of the aerosol generating article 100, and the third portion 130 may be arranged at the downstream of the aerosol generating article 100 relative to the second portion 120.

The third portion 130 may include a filter element. The filter element may include a cellulose acetate filter. The shape of the third portion 130 is not limited. For example, the third portion 130 may include a cylinder-type rod, or may include a tube-type rod having a hollow inside. In addition, the third portion 130 may include a recess-type rod. When the third portion 130 includes a plurality of segments, at least one of the plurality of segments may have a different shape.

The third portion 130 may be formed to generate flavors. For example, a flavoring liquid may be sprayed onto the third portion 130, or a separate fiber coated with a flavoring liquid may be inserted into the third portion 130.

In addition, the third portion 130 may further include a cooling element. The cooling element may include a cooling material that cools an airflow passing through the first portion 110 and the second portion 120. The cooling element may include a polymer material or a biodegradable polymer material, and may have a cooling function. For example, the cooling element may include pure polylactic acid (PLA) alone, but is not limited thereto.

In some embodiments, the cooling element may include a cellulose acetate filter having a plurality of holes. However, the cooling element is not limited to the above-described examples, and may include any material capable of cooling aerosol. For example, the cooling element may include a tube filter including a hollow, or may include a paper tube filter.

The aerosol generating article 100 may further include at least one of the first wrapper 140 and the second wrapper 150.

The first wrapper 140 may surround at least a portion of the first portion 110 and the second portion 120. The first wrapper 140 may include, for example, a thermally conductive wrapper. Preferably, the first wrapper 140 may include an aluminum thin film. When the first portion 110 is ignited and combusted, heat generated in the first portion 110 may be directly transferred to the second portion 120, or heat generated in the first portion 110 may be transferred to the second portion 120 through the first wrapper 140. The first wrapper 140 may have, for example, a thermal conductivity of about 50 $W \cdot m^{-1}/K^{-1}$ to about 500 $W \cdot m^{-1}/K^{-1}$.

The second wrapper 150 may surround the first portion 110, the second portion 120, and the third portion 130. The second wrapper 150 may include, for example, a cellulose wrapper. However, the present disclosure is not limited thereto.

In addition, the aerosol generating article 100 may further include a barrier (not shown) arranged between the first portion 110 and the second portion 120. The barrier may reduce movement of harmful gas generated in the first portion 110 to the second portion 120 or the third portion 130. The barrier may include, for example, a metal material. Accordingly, the user may inhale only required components in the form of aerosol.

In an embodiment, the flavoring element may be arranged apart from an end of the aerosol generating article 100. In detail, the flavoring element may be arranged apart from an end of the first portion 110 which is opposite to another end of the first portion 110, the other end being adjacent to the second portion 120. When the flavoring element is arranged in an area separated by a certain distance from the end of the first portion 110, the flavoring element may be prevented from generating an aroma due to being directly heated by an external heat source, such as a lighter or matches. The flavoring element may not be directly heated by the external heat source, and may generate an aroma due to heat transferred from the combustible heat source. However, when the flavoring element is directly heated by the external heating source, the flavoring element may receive heat from the external heat source and generate an aroma before the combustible heat source is ignited and combusted. Because the user may inhale the generated aroma and stop an action for ignition before the combustible heat source is ignited, incomplete ignition may occur.

For example, the first portion 110 may have a length of about 8 mm to about 13 mm, and the flavoring element may be arranged in an area that is apart by about 2 mm to about 3 mm from the end of the first portion 110 which is opposite to the other end of the first portion 110, the other end being adjacent to the second portion 120.

In an embodiment, the combustible heat source may include a first area and a second area, the first area being surrounded by the first wrapper 140, and the second area protruding outward of the first area and having the flavoring element arranged therein. In detail, the second area may protrude outward of the first area in the longitudinal direction of the aerosol generating article 100, and may not be surrounded by the first wrapper 140.

Ignition of the combustible heat source mainly occurs in the second area, and a timing at which the user recognizes whether the combustible heat source is ignited may vary depending on a position at which the flavoring element is arranged.

The flavoring element may be present in the second area of the combustible heat source which is not surrounded by the first wrapper 140. When the second area of the combustible heat source is ignited, because the flavoring element is arranged at a portion where the combustible heat source is ignited, an aroma may be generated at the same time as the combustible heat source is ignited. Accordingly, the user may recognize the fact that the combustible heat source is ignited at the same time as the combustible heat source is ignited.

For example, the first portion 110 may have a length of about 8 mm to about 13 mm, and the first wrapper 140 may surround at least a portion of the first portion 110. The length of the first area surrounded by the first wrapper 140 may be about 3 mm to about 5 mm, and the length of the second area that is not surrounded by the first wrapper 140 and protrudes outward may be about 5 mm to about 8 mm.

However, the flavoring element may also be present in the first area of the combustible heat source which is not surrounded by the first wrapper 140. When the first area of the combustible heat source is ignited, because the flavoring element is arranged apart from a portion where the combustible heat source is ignited, heat generated by combustion of the combustible heat source may be transferred to the flavoring element after a certain period of time elapses. Accordingly, the flavoring element may generate an aroma after a certain period of time elapses from a time when the combustible heat source is initially ignited, and the user may recognize the fact that the combustible heat source is ignited after a certain period of time elapses from the time of the initial ignition of the combustible heat source.

The flavoring element contained in the combustible heat source may have a capsule form, a sheet form, or an elongated form. Hereinafter, the form of the flavoring element and the position of the flavoring element inside the aerosol generating article 100 are described in detail with reference to FIGS. 2 to 4.

Figure 2A:
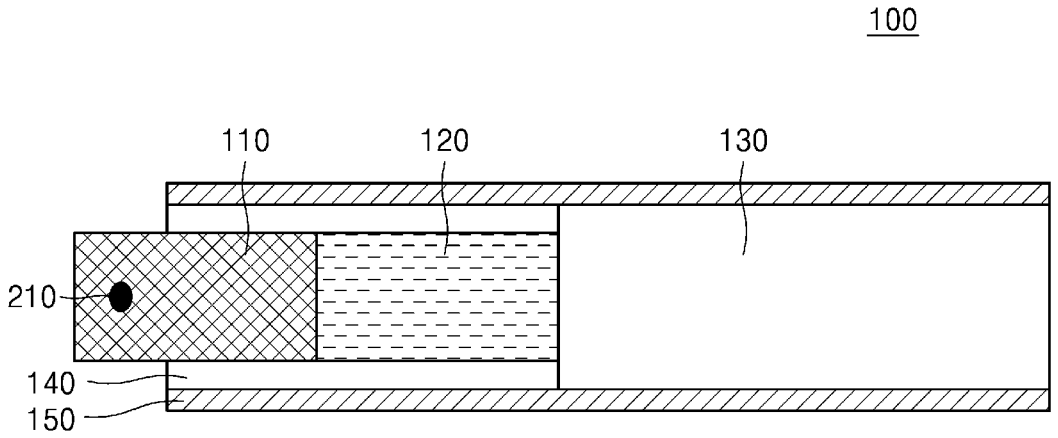
FIG. 2A is a diagram illustrating a configuration of an aerosol generating article including a flavoring element having a capsule form, according to an embodiment.

FIG. 2A is a diagram illustrating a configuration of an aerosol generating article including a flavoring element having a capsule form, according to an embodiment.

Referring to FIG. 2A, the flavoring element may include a first capsule 210, and the first capsule 210 may be arranged inside the combustible heat source. A flavoring material may be included in the combustible heat source by being surrounded by a film of the first capsule 210. For example, the film of the first capsule 210 may include agar, pectin, sodium alginate, carrageenan, gelatin, or gum, such as guar gum. In addition, a curing aid may be used as a material for forming the film of the first capsule 210. Here, for example, calcium chloride may be used as a gelling aid. In addition, a plasticizer may be used as the material for forming the film of the first capsule 210. Here, glycerin and/or sorbitol may be used as the plasticizer. In addition, a colorant may be used as the material for forming the film of the first capsule 210.

In an embodiment, the first capsule 210 may be arranged in an area that is apart by about 2 mm to about 8 mm from the end of the first portion 110 which is opposite to the other end of the first portion 110, the other end being adjacent to the second portion 120. Because the first capsule 210 is arranged in an area separated by a certain distance from the end of the first portion 110, the flavoring element may be prevented from generating an aroma due to being directly heated by an external heat source. In addition, because the flavoring element generates an aroma after complete ignition of the combustible heat source is achieved, it is possible to prevent a situation in which the user stops an action for ignition before complete ignition is achieved.

Figure 2B:
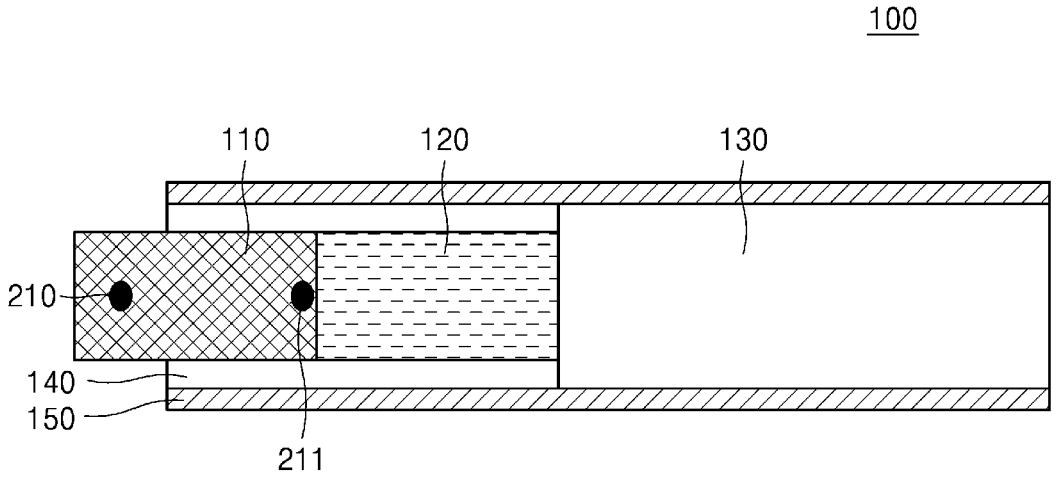
FIG. 2B is a diagram illustrating a configuration of an aerosol generating article including a plurality of flavoring elements each having a capsule form, according to an embodiment.

FIG. 2B is a diagram illustrating a configuration of an aerosol generating article including a plurality of flavoring elements each having a capsule form, according to an embodiment.

Referring to FIG. 2B, the flavoring element may include the first capsule 210 and a second capsule 211. Flavoring materials may be included in the combustible heat source by being surrounded by films of the first capsule 210 and the second capsule 211. According to an embodiment, the number of capsules may increase or decrease.

The second capsule 211 may be arranged in an area that is apart from the first capsule 210 in the longitudinal direction of the aerosol generating article 100. In addition, the second capsule 211 may be arranged in an area adjacent to the second portion 120. Because the second capsule 211 is arranged in an area adjacent to the second portion 120, when an aroma is generated by the flavoring element of the second capsule 211, the user may recognize that the aerosol generating article 100 is in a state in which smoking is possible. In an embodiment, the first capsule 210 may be arranged in an area that is apart by about 2 mm to about 8 mm from the end of the first portion 110 which is opposite to the other end of the first portion 110, the other end being adjacent to the second portion 120, and the second capsule 211 may be arranged in an area that is apart by about 8 mm to about 13 mm from the end of the first portion 110.

A flavoring material surrounded by the first capsule 210 may be the same as or different from a flavoring material surrounded by the second capsule 211. For example, the flavoring material surrounded by the first capsule 210 may include coffee, and the flavoring material surrounded by the second capsule 211 may include a tobacco material. When the user inhales a coffee aroma, the user may recognize that the combustible heat source is ignited, and when the user inhales a tobacco aroma, the user may recognize that the aerosol generating article 100 is in a state in which smoking is possible.

Figure 3:
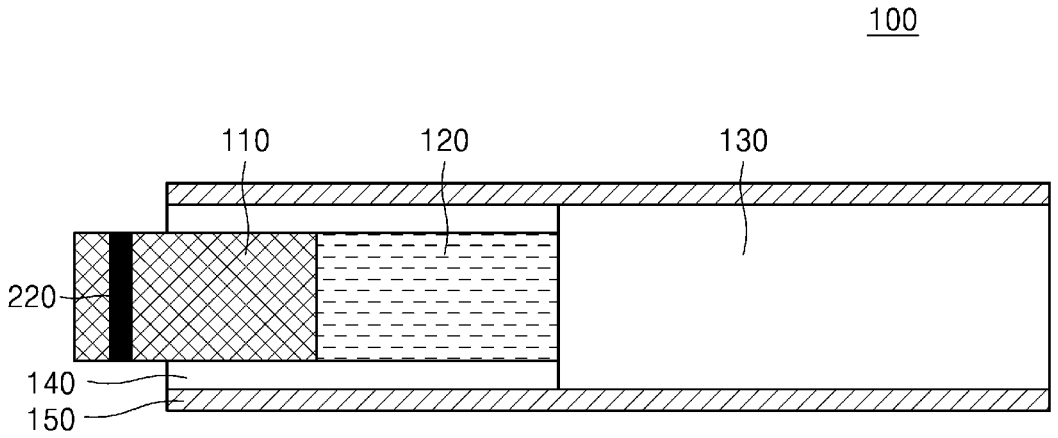
FIG. 3 is a diagram illustrating a configuration of an aerosol generating article including a flavoring element having a sheet form, according to an embodiment.

FIG. 3 is a diagram illustrating a configuration of an aerosol generating article including a flavoring element having a sheet form, according to an embodiment.

Referring to FIG. 3, the flavoring element may include a sheet 220, and may surround at least a portion of an outer circumferential surface of the combustible heat source. The flavoring element may be prepared by applying a flavoring material to a film in a liquid state, or by impregnating a film into a flavoring material in a liquid state. The sheet 220 including the flavoring material may be included in the combustible heat source by surrounding the combustible heat source.

In an embodiment, the sheet 220 may surround the combustible heat source in the form of a band. Because the sheet 220 in the form of a band surrounds the entire outer circumferential surface of the combustible heat source, the sheet 220 may generate an aroma regardless of a position on a circumference of the combustible heat source ignited by the user. Accordingly, the user is not required to heat the outer circumferential surface of the combustible heat source only at a specific position.

In addition, the sheet 220 may be surrounded by at least one of the first wrapper 140 and the second wrapper 150. Because the first wrapper 140 or the second wrapper 150 surrounding the sheet 220 brings the sheet 220 into close contact with the combustible heat source, and thus increases adhesion between the sheet 220 and the combustible heat source, even when an external impact is applied to the aerosol generating article 100, or the combustible heat source is ignited and combusted, the sheet 220 may not be separated from the combustible heat source.

Figure 4A:
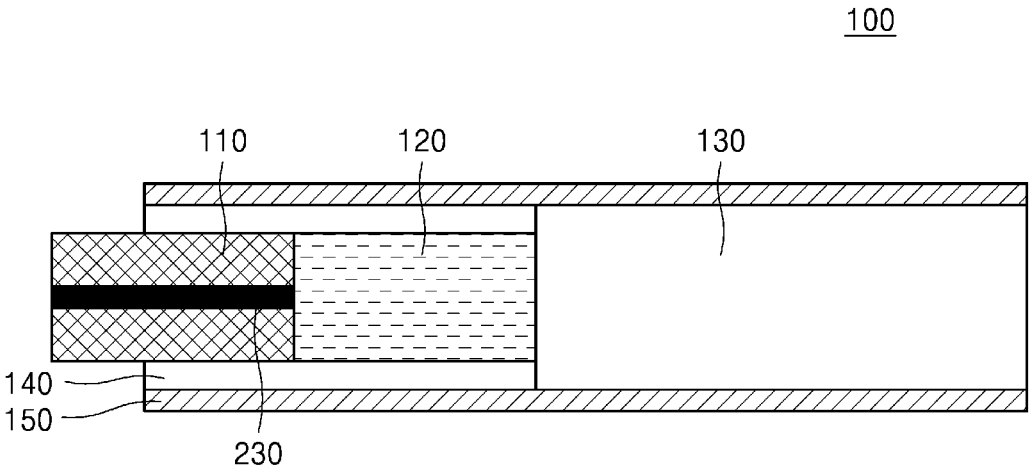
FIG. 4A is a diagram illustrating a configuration of an aerosol generating article including a flavoring element having an elongated form, according to an embodiment.

FIG. 4A is a diagram illustrating a configuration of an aerosol generating article including a flavoring element having an elongated form, according to an embodiment.

Referring to FIG. 4A, the flavoring element may include an elongated bar 230, and may be arranged on the combustible heat source coaxially with the longitudinal direction of the aerosol generating article 100. The flavoring element may be prepared by applying a flavoring material to an elongated bar in a liquid state, or by impregnating an elongated bar into a flavoring material in a liquid state. The elongated bar including the flavoring material may be included in the combustible heat source by being inserted into a void of the combustible heat source.

In an embodiment, the elongated bar 230 may be inserted into a central portion of the combustible heat source. In order for the elongated bar 230 to be inserted into the central portion of the combustible heat source, a passage extending in the longitudinal direction of the aerosol generating article 100 may be formed in the central portion of the combustible heat source. The elongated bar 230 may be arranged coaxially with the longitudinal direction of the aerosol generating article 100.

In addition, the length of the elongated bar 230 may be the same as the length of the combustible heat source. For example, the length of the elongated bar 230 may be about 8 mm to 13 mm. Because the elongated bar 230 allows the flavoring element to be present throughout the combustible heat source in the longitudinal direction of the aerosol generating article 100, the elongated bar 230 may generate an aroma regardless of on which position in the circumference of the combustible heat source the user performs ignition. The user may recognize the fact that the combustible heat source is ignited at the same time as the combustible heat source is ignited. Accordingly, the user is not required to heat only a specific position of the combustible heat source.

Figure 4B:
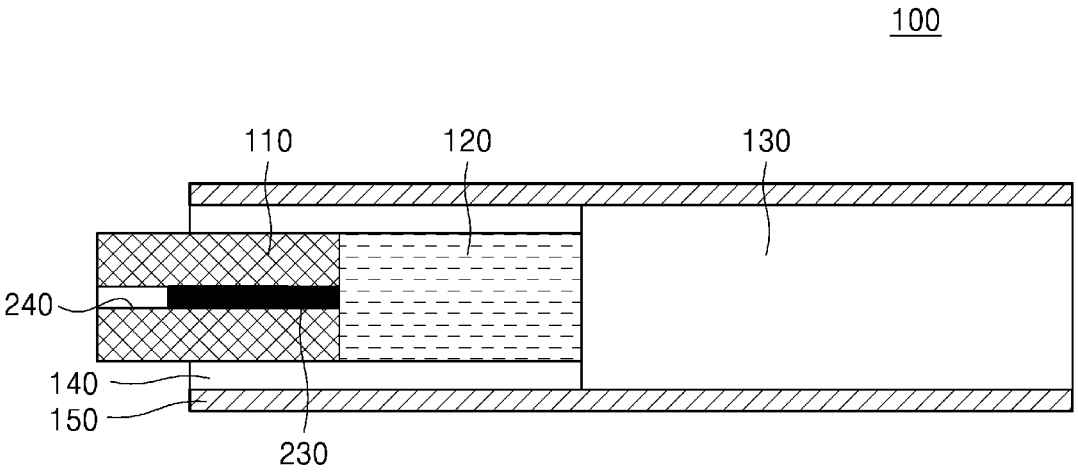
FIG. 4B is a diagram illustrating a configuration of an aerosol generating article further including a combustion body, according to an embodiment.

FIG. 4B is a diagram illustrating a configuration of an aerosol generating article further including a combustion body, according to an embodiment.

Referring to FIG. 4B, the first portion 110 further includes a combustion body 240, and the combustion body 240 may be arranged adjacent to the flavoring element. The combustion body 240 may be immersed in alcohol. The combustion body 240 immersed in the alcohol may include, for example, a string, a thread, paper, or a wooden stick, which is impregnated with ethanol. In addition, the combustion body 240 may include a solid fuel or a metal wire. The solid fuel may include, for example, an ignition auxiliary agent, such as solid methyl alcohol. The metal wire may include, for example, a magnesium ribbon and the like. The combustion body 240 may have a higher combustion rate than the combustible heat source. When the combustible heat source is ignited, the combustion body 240 may also be ignited and generate heat. The generated heat may be transferred to the flavoring element, and the flavoring element may generate an aroma due to the heat transferred from the combustion body 240. By using the combustion body 240 having a higher combustion rate than the combustible heat source, the user may recognize that the combustible heat source is ignited more quickly than when only the combustible heat source is used.

In an embodiment, the combustion body 240 may be arranged adjacent to the elongated bar 230, and the combustion body 240 and the elongated bar 230 may be arranged on the combustible heat source coaxially with the longitudinal direction of the aerosol generating article 100. When the combustible heat source is ignited, the combustion body 240 is also ignited, and heat generated in the combustion body 240 may be transferred to the flavoring element adjacent thereto, so that the flavoring element may generate an aroma.

Another aspect of the present disclosure may provide a combustible heat source for an aerosol generating article, wherein the combustible heat source may include a flavoring element.

The matters described with respect to the above aspect of the present disclosure may equally apply to the other aspect of the present disclosure.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating article comprising:

a first portion comprising a combustible heat source;

a second portion comprising a tobacco element; and a third portion comprising a filter element, wherein the first portion, the second portion, and the third portion are sequentially arranged in a longitudinal direction of the aerosol generating article, wherein the combustible heat source comprises a flavoring element, wherein the first portion further comprises a combustion body that is immersed in alcohol and has a higher combustion rate than the combustible heat source, and wherein the combustion body is arranged adjacent to the flavoring element.

2. The aerosol generating article of claim 1, wherein the flavoring element is configured to generate an aroma after the combustible heat source is ignited.

3. The aerosol generating article of claim 1, wherein the flavoring element comprises a flavoring material selected from a group consisting of a tobacco material, licorice, sucrose, fructose syrup, cocoa, coffee, and combinations thereof.

4. The aerosol generating article of claim 1, wherein the flavoring element is arranged apart from an end of the first portion which is opposite to another end of the first portion, the other end being adjacent to the second portion.

5. The aerosol generating article of claim 1, further comprising a first wrapper surrounding at least a portion of the first portion and the second portion.

6. The aerosol generating article of claim 5, wherein the combustible heat source comprises a first area and a second area, the first area being surrounded by the first wrapper, and the second area protruding outward of the first area and having the flavoring element arranged therein.

7. The aerosol generating article of claim 1, wherein the combustible heat source comprises a plurality of flavoring elements, and the plurality of flavoring elements are arranged apart from each other in the longitudinal direction of the aerosol generating article.

8. The aerosol generating article of claim 1, wherein the flavoring element has a capsule form and is arranged inside the combustible heat source.

9. The aerosol generating article of claim 1, wherein the flavoring element has a sheet form and surrounds at least a portion of the combustible heat source.

10. The aerosol generating article of claim 1, wherein the flavoring element has an elongated form and is arranged on the combustible heat source coaxially with the longitudinal direction of the aerosol generating article.

* * * * *